US010731298B2

(12) United States Patent
Bilodeau et al.

(10) Patent No.: US 10,731,298 B2
(45) Date of Patent: Aug. 4, 2020

(54) RELEASE PAPER AND METHOD OF MANUFACTURE

(71) Applicants: University of Maine System Board of Trustees, Orono, ME (US); Stirling Consulting, INC., Yarmouth, ME (US)

(72) Inventors: Michael A. Bilodeau, Brewer, ME (US); Robert H. Hamilton, Yarmouth, ME (US)

(73) Assignees: University of Maine System Board of Trustees, Orono, ME (US); Stirling Consulting, Inc., Yarmouth, ME (US)

( * ) Notice: Subject to any disclaimer, the term of this patent is extended or adjusted under 35 U.S.C. 154(b) by 798 days.

(21) Appl. No.: 14/407,759

(22) PCT Filed: Jun. 14, 2013

(86) PCT No.: PCT/US2013/045832
§ 371 (c)(1),
(2) Date: Dec. 12, 2014

(87) PCT Pub. No.: WO2013/188739
PCT Pub. Date: Dec. 19, 2013

(65) Prior Publication Data

US 2015/0125658 A1 May 7, 2015

Related U.S. Application Data

(60) Provisional application No. 61/660,378, filed on Jun. 15, 2012.

(51) Int. Cl.
*D21H 27/00* (2006.01)
*D21H 19/72* (2006.01)
(Continued)

(52) U.S. Cl.
CPC ..... *D21H 27/001* (2013.01); *D21H 11/18* (2013.01); *D21H 17/25* (2013.01); *D21H 17/28* (2013.01);
(Continued)

(58) Field of Classification Search
CPC .. D21H 27/0017; D21H 25/02; D21H 25/005; D21H 19/72; D21H 19/54;
(Continued)

(56) References Cited

U.S. PATENT DOCUMENTS 3,794,558 A * 2/1974 Back ..... D21H 17/29 162/175
5,308,441 A 5/1994 Kern
(Continued)

FOREIGN PATENT DOCUMENTS

EP 1509654 B1 1/2007
EP 2196478 A1 6/2010
(Continued)

OTHER PUBLICATIONS

EP Extended Search Report, Application No. 13804538.0, dated Jun. 9, 2015.
(Continued)

*Primary Examiner* — Nancy R Johnson
(74) *Attorney, Agent, or Firm* — MacMillan, Sobanski & Todd, LLC

(57) ABSTRACT

Release base papers with improved surface properties and more efficient manufacturing potential are made using cellulose nanofibrils (CNF) along with high freeness, less refined pulp. Release papers serve as the backing for common adhesive labels, for industrial film coatings, and also for certain food processing uses. The CNF may be added to the furnish and processed to paper, or the CNF may be added as a coating onto a partially dried web of paper. The CNF
(Continued)

Control Release Base

Release Base with CNF-Starch may optionally be combined with a starch and a starch crosslinker.

13 Claims, 5 Drawing Sheets

(51) Int. Cl.

| | |
|---|---|
| ***D21H 25/00*** | (2006.01) |
| ***D21H 17/28*** | (2006.01) |
| ***D21H 17/25*** | (2006.01) |
| ***D21H 21/52*** | (2006.01) |
| ***D21H 19/54*** | (2006.01) |
| ***D21H 21/14*** | (2006.01) |
| ***D21H 11/18*** | (2006.01) |
| ***D21H 19/34*** | (2006.01) |
| ***D21H 19/52*** | (2006.01) |
| ***D21H 25/02*** | (2006.01) |

(52) U.S. Cl.
CPC ..... *D21H 19/34* (2013.01); *D21H 19/52* (2013.01); *D21H 19/54* (2013.01); *D21H 19/72* (2013.01); *D21H 21/14* (2013.01); *D21H 21/52* (2013.01); *D21H 25/005* (2013.01); *D21H 25/02* (2013.01); *Y10T 428/24355* (2015.01); *Y10T 428/31982* (2015.04); *Y10T 428/31993* (2015.04)

(58) Field of Classification Search
CPC ..... D21H 19/34; D21H 19/52; D21H 11/18; D21H 21/14; D21H 21/52; D21H 17/25; D21H 17/28; Y10T 428/31993; Y10T 428/24355; Y10T 428/31982
See application file for complete search history.

(56) References Cited

U.S. PATENT DOCUMENTS

| | | | | |
|---|---|---|---|---|
| 5,964,983 | A | 10/1999 | Dinand et al. | |
| 7,387,703 | B2 | 6/2008 | Koskinen et al. | |
| 8,361,278 | B2 | 1/2013 | Fike et al. | |
| 8,377,563 | B2 | 2/2013 | Miyawaki et al. | |
| 2002/0096277 | A1 | 7/2002 | Lau et al. | |
| 2004/0152825 | A1* | 8/2004 | Yamamoto | C08L 29/04 524/503 |
| 2010/0065235 | A1* | 3/2010 | Fike | D21H 13/08 162/146 |
| 2010/0065236 | A1 | 3/2010 | Henriksson et al. | |
| 2012/0043039 | A1 | 2/2012 | Paltakari et al. | |
| 2012/0080156 | A1 | 4/2012 | Laleg et al. | |
| 2012/0094953 | A1 | 4/2012 | Gane et al. | |
| 2012/0132383 | A1 | 5/2012 | Laine et al. | |
| 2012/0214979 | A1 | 8/2012 | Heiskanen et al. | |
| 2012/0277351 | A1 | 11/2012 | Yano et al. | |
| 2013/0000855 | A1 | 1/2013 | Nuopponen et al. | |
| 2013/0012695 | A1 | 1/2013 | Turner et al. | |
| 2013/0280545 | A1* | 10/2013 | Husband | D21H 17/25 428/464 |
| 2014/0338849 | A1* | 11/2014 | Kosonen | C08B 15/04 162/1 |
| 2015/0330023 | A1* | 11/2015 | Hillebrand | D21C 9/18 162/9 |

FOREIGN PATENT DOCUMENTS

| | | | |
|---|---|---|---|
| EP | 2265760 | A1 | 12/2010 |
| EP | 2300544 | A1 | 3/2011 |
| EP | 2094910 | B1 | 1/2012 |
| EP | 2440704 | A1 | 4/2012 |
| EP | 2440705 | A1 | 4/2012 |
| EP | 2494107 | A1 | 9/2012 |
| EP | 2504487 | A1 | 10/2012 |
| EP | 2532782 | A1 | 12/2012 |
| EP | 2551406 | A1 | 1/2013 |
| EP | 2563966 | A1 | 3/2013 |
| EP | 2569468 | A1 | 3/2013 |
| WO | 97/12917 | A1 | 4/1997 |
| WO | 99/08784 | A1 | 2/1999 |
| WO | 2005071161 | A1 | 8/2005 |
| WO | 2009122982 | A1 | 10/2009 |
| WO | 2009126106 | A1 | 10/2009 |
| WO | 2009147283 | A1 | 12/2009 |
| WO | 2010066905 | A1 | 6/2010 |
| WO | 2010092239 | A1 | 8/2010 |
| WO | 2010142845 | A1 | 12/2010 |
| WO | 2010142846 | A1 | 12/2010 |
| WO | 2011051882 | A1 | 5/2011 |
| WO | 2011064441 | A1 | 6/2011 |
| WO | 2011068023 | A1 | 6/2011 |
| WO | 2011104427 | A1 | 9/2011 |
| WO | 2011118746 | A1 | 9/2011 |
| WO | 2011128322 | A2 | 10/2011 |
| WO | 2011134939 | A1 | 11/2011 |
| WO | 2011140643 | A1 | 11/2011 |
| WO | 2012043103 | A1 | 4/2012 |
| WO | 2012098296 | A2 | 7/2012 |
| WO | 2012098296 | A3 | 7/2012 |
| WO | 2012115590 | A1 | 8/2012 |
| WO | 2012132663 | A1 | 10/2012 |
| WO | 2013017731 | A1 | 2/2013 |
| WO | 2014194215 | A2 | 12/2014 |

OTHER PUBLICATIONS

Duraiswamy et al., "The Effect of Starch Type on the Silicone Hold-out of Release Papers," Western Michigan University, Mar. 2001.
International Search Report, Application No. PCT/US2013/045832, dated Sep. 23, 2013.
Canadian Office Action, Application No. 2,876,083, dated Jul. 10, 2019.

* cited by examiner

Control Release Base

Release Base with CNF-Starch

RELEASE PAPER AND METHOD OF MANUFACTURE

RELATED APPLICATIONS

This application claims priority to U.S. provisional application Ser. No. 61/660,378, filed Jun. 15, 2012 and incorporated herein by reference.

BACKGROUND OF THE INVENTION

The present invention relates generally to the field of paper making and, in particular, to the manufacture of release base papers. More specifically, the invention relates to a process for incorporating nano-fibrillated cellulose fibers, also known as cellulose nanofibrils (CNF), into release base papers and the release papers made by this process.

Release base papers are the largest true specialty paper market, with a global market size of nearly 34 billion square meters, equating to approximately 2,700,000 tons of base materials. This includes both release and casting papers and filmic substrates. North America alone, uses over 750,000 tons of paper and 120,000 tons of film for release base in all applications.

"Release papers" are known in the art as a base paper having a silicone or other inert release agent coated on the surface of the base paper. In many applications, the release paper may serve as a substrate for a secondary layer. Examples of substrates with secondary layers include, for example, pressure-sensitive adhesive labels, and "casting substrates" for industrial polymeric or thermoplastic films. In other applications, the release paper may be used without a secondary layer, for example with certain food processes, such as baking cups and sheets or interlayers between sliced foods.

Release base papers require strength, a very smooth finish, low air permeability, and a high degree of coating holdout. Some applications also require that a release base paper have a high degree of translucency or transparency. Other applications require that a casting substrate remain dimensionally stable over a wide range of temperatures and humidities in order to withstand exposure to high temperature for curing of a silicone release coating of the materials cast on the sheet and to lie flat while the pressure sensitive material (usually a label or signage) is printed and applied to the object to be labeled or decorated.

Release base papers with low air permeability may be produced by using very low freeness pulps as part of the paper-making furnish. Low freeness pulps are heavily refined which retards paper machine productivity by slowing drainage during the sheet forming process, lowers dimensional stability of the final product, and increases manufacturing costs, including higher refiner energy and drying energy usage. Thus, generating the above mentioned properties in conventionally furnished papers requires high levels of energy usage, reduced machine operating speeds, and/or the use of petrochemical based content coatings, which includes extrusion coatings of polyethylene, or polypropylene, or 100% petrochemical based film—usually a polyester.

Plastic films or petrochemical based content coatings used in the prior art are directly affected by the price of oil, and as a result, their cost is subject to price fluctuation. Plastic films or petrochemical based content coatings are also not easily recycled, nor can they be disposed of with biodegradable materials; which further increases the disposal and total use costs.

Therefore there is a need in the art for a more energy and cost efficient process that provides for the manufacturing of release base papers and casting substrates, and materials to facilitate such a process.

SUMMARY OF THE INVENTION

The invention relates to release papers and release base papers before a release agent is applied. In one aspect, the invention comprises a method for producing a release base paper, the method comprising a. manufacturing a release base paper with a paper-making furnish having a fiber freeness (CSF) of 180 ml or higher;
b. pressing the furnish into a web of paper;
c. drying the pressed web; and
d. calendering the web to form a release base paper
e. wherein the release base paper is manufactured with nano-fibrillated cellulose added to the release base paper by means of at least one of: (i) incorporation into the furnish at a loading concentration of from about 10 to about 400 lbs/ton; and (ii) coating on the web of paper at a coating rate of about 0.2 to about 12 g/m$^2$.

In embodiments where the nano-fibrillated cellulose is incorporated into the furnish, it may be incorporated at a loading concentration of from about 20 to about 200 lbs/ton, or from about 50 to about 150 lbs/ton. When the nano-fibrillated cellulose is added to the release base paper by means of coating it on a partially dried web of paper, it may be coated at a coating rate of about 0.5 to about 5 g/m$^2$. In either case the remainder of the pulp fiber is less refined fiber and may have a freeness (CSF) of 200 ml or more, 250 ml or more, or even 300 ml or more.

In some embodiments, the nano-fibrillated cellulose may be mixed with a carbohydrate such as a starch. The carbohydrate may be a starch selected from unmodified potato, corn, pearl or tapioca starches, or modified starches. The starch may first be crosslinked to form a hydrogel before being added to the furnish or coating.

In some embodiments, the method may include an optional sizing step, but preferably this can be omitted. In some embodiments, the method may include an optional pre-coating or coating step, but preferably these can be omitted. The method may further comprise coating the release base paper with a release agent to form a release paper. Typical release agents include a wide variety of silicones as described herein.

In another aspect, the invention provides a furnish for producing a release base paper, the furnish comprising:

a. a paper-making pulp having an initial fiber freeness (CSF) of 180 ml or higher; and
b. nano-fibrillated cellulose at a loading concentration of from 10 to about 400 lbs/ton.

On a dry weight percentage basis, the 10 to 400 lbs/ton of nano-fibrillated cellulose represents 0.5% to 20%. The remainder of the pulp fiber is less refined fiber and may have a freeness (CSF) of 200 ml or more, 250 ml or more, or even 300 ml or more. The furnish may further comprise a carbohydrate, such as a starch selected from unmodified or modified starches. Unmodified starches may include, for example, potato, corn, pearl or tapioca starches. The carbohydrate may be a blend of starches (modified or unmodified) or a blend of sources. The furnish may also include at least one further ingredient selected from: organic materials including but not limited to carbohydrates and starches; and inorganic materials, including but not limited to clays and pigments.

In another aspect, the invention relates to novel release base papers. For example, the invention relates to release base paper manufactured by the method of any of claims 1-8. A release paper manufactured any of these methods may be further coated with a release agent. A release paper may be manufactured using the furnish of any of claims 9-14, and further coated with a release agent. In each case, the release agent includes a silicone-based coating.

The invention also provides for a release base paper, independent of how it is manufactured, comprising a fibrous composition including from about 0.5% to 20% cellulose nanofibrils (CNF) based on the dry weight of the fibrous composition, the remainder of the fibrous composition being less refined paper pulp, characterized in that, when unsized and uncoated, it has at least two of the following properties:

a. a Gurley Porosity of at least 300 seconds;
b. a dimensional stability characterized by shrinkage of less than 10%;
c. a PPS (S-10) smoothness of less than about 2 microns;
d. an apparent density of at least about 18.0; and
e. a holdout characterized by a dark dye penetration of (i) not more than about 3% of the obverse side area stained by dye in a dirt estimation test; or (ii) a reduction in reflectance or brightness of no more than 20%.

The remainder of the fibrous composition may be "less refined pulp" as defined by a pulp having a fiber freeness (CSF) of 180 ml or more, 200 ml or more, 250 ml or more, or 300 ml or more. "Less refined pulp" may also include pulp refined to an extent such that it includes not more than 70% fines, not more than 60% fines, or not more than 50% fines.

Although the release paper may ultimately be surface sized or coated, the paper properties recited above are for unsized and uncoated papers. Any two properties may be present without regard to the type of property. For example, a specified porosity and shrinkage; a specified density and smoothness; a specified smoothness and porosity; etc. It is, of course, possible that a paper may possess three or more properties, four or more properties, or all of the properties.

In a further aspect, the invention comprises a sizing or coating formulation for addition to a release base paper, the formulation comprising nano-fibrillated cellulose, said sizing formulation to be applied to partially dried web. The nano-fibrillated cellulose may be any of those characterized herein, and may be combined with a carbohydrate or starch as indicated above for the furnish.

In one embodiment of the present invention, the nano-fibrillated cellulose can be chemically modified, or blended with other low surface energy materials including inorganic materials, producing release base papers that are fully functioning without subsequent silicone coating.

It is an objective of the present invention to provide a paper-based release liner that may effectively replace highly densified release base papers and/or poly-coated liners in high speed labeling (including "no label look" clear film labels), tapes, medical applications such as transdermal medication patches, hygiene applications such as feminine hygiene and bandage, industrial applications such as film casting and graphic arts uses such as truck/bus signage.

Another objective of the present invention is to reduce basis weight requirements for applications where release base papers are used, resulting in better material-yields, improved downstream processing efficiencies and less material requiring disposal or recycling through improved tensile strength.

A further objective of the present invention is to reduce silicone coating demand by improving the release paper's holdout and providing a more even (smooth) and planar (fewer pits or voids) coating surface, reducing usage of coating material, costs and lowering energy consumption for curing. This is significant as silicone coatings and the associated energy costs to cure them represent a large share of the silicone release paper's final cost.

Yet another objective of the present invention is to provide more thermal and dimensional stability compared to the currently used films and papers, especially important in graphic arts and casting applications.

Still another objective of the current invention is to provide a freer draining furnish that requires less energy, reduces the need to calender, and increases productivity of the papermaking process.

Other advantages and features are evident from the following detailed description.

BRIEF DESCRIPTION OF THE DRAWINGS

The accompanying drawings, incorporated herein and forming a part of the specification, illustrate the present invention in its several aspects and, together with the description, serve to explain the principles of the invention. In the drawings, the thickness of the lines, layers, and regions may be exaggerated for clarity.

Figure 1:
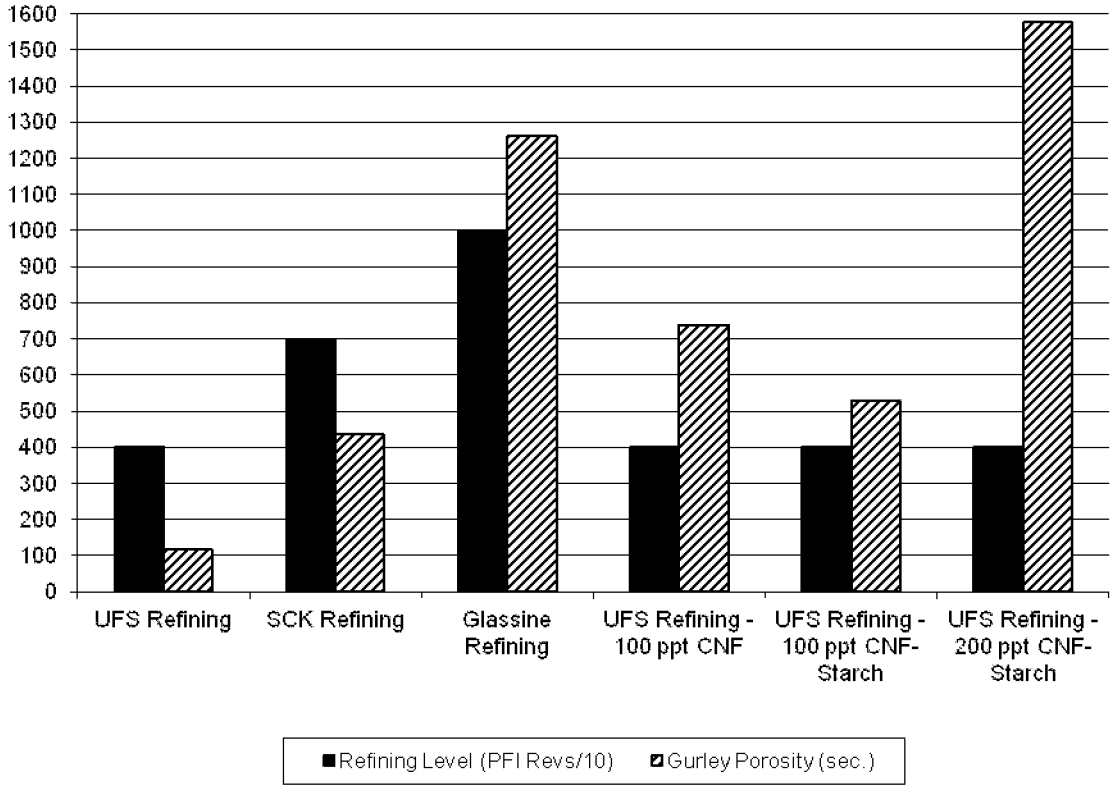
FIGS. 1 to 4 are charts of data, further described in the Examples.

Various aspects of this invention will become apparent to those skilled in the art from the following detailed description of the preferred embodiment, when read in light of the accompanying drawings.

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references cited herein, including books, journal articles, published U.S. or foreign patent applications, issued U.S. or foreign patents, and any other references, are each incorporated by reference in their entireties, including all data, tables, figures, and text presented in the cited references.

Numerical ranges, measurements and parameters used to characterize the invention—for example, angular degrees, quantities of ingredients, polymer molecular weights, reaction conditions (pH, temperatures, charge levels, etc.), physical dimensions and so forth—are necessarily approximations; and, while reported as precisely as possible, they inherently contain imprecision derived from their respective measurements. Consequently, all numbers expressing ranges of magnitudes as used in the specification and claims are to be understood as being modified in all instances by the term "about." All numerical ranges are understood to include all possible incremental sub-ranges within the outer boundaries of the range. Thus, a range of 30 to 90 degrees discloses, for example, 35 to 50 degrees, 45 to 85 degrees, and 40 to 80 degrees, etc.

Cellulosic Materials

Cellulose, the principal constituent of "cellulosic materials," is the most common organic compound on the planet. The cellulose content of cotton is about 90%; the cellulose content of wood is about 40-50%, depending on the type of wood. "Cellulosic materials" includes native sources of cellulose, as well as partially or wholly delignified sources. Wood pulps are a common, but not exclusive, source of cellulosic materials. Wood pulps may be derived from hardwoods or conifers.

Cellulose is a polymer derived from D-glucose units, which condense through beta (1-4)-glycosidic bonds. This linkage motif contrasts with that for alpha (1-4)-glycosidic bonds present in starch, glycogen, and other carbohydrates. Cellulose is a straight chain polymer: unlike starch, no coiling or branching occurs, and the molecule adopts an extended and rather stiff rod-like conformation, aided by the equatorial conformation of the glucose residues. The multiple hydroxyl groups on a glucose molecule from one chain form hydrogen bonds with oxygen atoms on the same or on a neighbor chain, holding the cellulose chains firmly together side-by-side and forming nanofibrils. Nanofibrils are similarly held together in larger fibrils known as microfibrils; and microfibrils are similarly held together in bundles or aggregates.

General Pulping and Refining Processes

Wood is converted to pulp for use in paper manufacturing. Pulp comprises wood fibers capable of being slurried or suspended and then deposited on a screen or porous surface to form a web or sheet of paper. There are two main types of pulping techniques: mechanical pulping and chemical pulping. In mechanical pulping, the wood is physically separated into individual fibers. In chemical pulping, the wood chips are digested with chemical solutions to solubilize a portion of the lignin and thus permit its removal. The commonly used chemical pulping processes include: (a) the kraft process, (b) the sulfite process, and (c) the soda process. These processes need not be described here as they are well described in the literature, including Smook, Gary A., Handbook for Pulp & Paper Technologists, TAPPI Press, 1992 (especially Chapter 4), and the article: "Overview of the Wood Pulp Industry," Market Pulp Association, 2007. The kraft process is the most commonly used and involves digesting the wood chips in an aqueous solution of sodium hydroxide and sodium sulfide. The wood pulp produced in the pulping process is usually separated into a fibrous mass and washed. They may be bleached to whiten and remove lignin.

Depending on the paper grade desired, the fibers may be further milled, ground, homogenized or refined by a mechanical comminution process that further breaks up the fibers. Such grinding apparatus are well known in the industry and include, without limitation, Valley beaters, single disk refiners, double disk refiners, conical refiners, including both wide angle and narrow angle, cylindrical refiners, homogenizers, microfluidizers, and other similar milling devices. These mechanical comminution devices need not be described in detail herein, since they are well described in the literature, for example, Smook, Gary A., Handbook for Pulp & Paper Technologists, TAPPI Press, 1992 (especially Chapter 13). The nature of the grinding apparatus is not critical, although the results produced by each may not all be identical. TAPPI standard T200 describes a procedure for mechanical processing of pulp using a beater. The process of mechanical breakdown, regardless of instrument type, is sometimes referred to in the literature as "refining," which is used herein interchangeably with comminution.

A "furnish" is the pulp slurry that is added to the headbox for paper making. The furnish contains the cellulosic pulp and water, and may be combined with clays, pigments, dyes, binders, or other organic or inorganic compounds or fillers suitable for the desired paper. In accordance with one embodiment of the present invention, the CNF may be added as part of the furnish.

Freeness is a standard measure in the paper industry and measures the ability of fibers to imbibe water as the drainability of water from the pulp. While there are multiple methods for measuring freeness, one frequently used measure is the Canadian Standard Freeness or CSF (TAPPI Standard Method T-227), which is the volume (in ml) of water that remains or is drainable after 3 grams of oven dried pulp is immersed in a liter of water at 20 C. A higher CSF means less water is absorbed and held by the fiber. Unrefined hardwood pulps have a CSF in the range of 600 to 500 ml; while unrefined conifer pulps hold less water and have a CSF in the range of 760 to 700 ml. As fibers are refined they tend to hold more water and the CSF decreases. For example, as shown in Example 1, Uncoated Freesheet (UFS) grade paper (typically used for copy paper) has a CSF of about 300. In contrast, the more highly refined or densified papers like SuperCalendered Kraft (SCK) and Glassine grade papers currently used as release base papers have lower CSF freeness in the range of about 170 to 100.

As used herein, the term "fiber freeness" refers to the initial freeness of the pulp fibers prior to the addition of any cellulose nanofibers (CNF). Typically, the freeness of each type of pulp fiber is measured before the fibers are blended into the pulp. In contrast, the "headbox freeness" refers to the freeness of all the pulp fibers—including the CNF, and any pigments, binders, clays fillers, starches or other ingredients—blended together. The higher the headbox freeness, the faster and more easily the water can be removed from the forming web. This, in turn, offers opportunity to increase production rates, reduce energy usage, or a combination of both, thereby improving process efficiency. While the addition of CNF to less refined pulps may lower the headbox freeness somewhat, a key advantage of the use of less refined, high freeness pulps, is the dimensional stability and other physical properties of the release base papers made. In addition to improved dimensional stability, the release base papers exhibit good tensile strength and tear strength, and lower opacity.

Properties of Release Base Papers

Release base papers must have certain desired properties. They should be dimensionally stable and not subject to shrinkage. They should be very smooth with an even surface and they should be rather impermeable to air. The denser and less porous they are, the more likely they are impermeable and will not encounter bleedthrough of secondary coatings such as release agents. The desired properties, if not present in the "uncoated" paper as made, can sometimes be imparted by various calendering, supercalendering and/or sizing or coating steps. But coatings (including sizings) add weight to the paper; and coating and calendering steps can add expense and/or delay to the manufacturing process and are less than desirable. It would be preferable if base papers having these desirable properties can be made without significant sizing or coating, and without significant calendering or supercalendering steps.

As used herein an "unsized and uncoated" base paper refers to the base paper as made without sizings or chemical precoatings or second coatings. However, "unsized and uncoated" does not exclude coating with CNF as with the embodiment shown at step 1.5 of FIG. 7; nor does "unsized and uncoated" exclude the release agent coating applied at step 1.9 that changes the "release base paper" to a "release paper."

Dimensional Stability refers to the ability of the paper sheet to maintain its dimensions over time. As a practical matter it can be measured as shrinkage in length or width dimensions expressed as a percent of the initial value. Humidity (ambient moisture) is a significant contributor to dimensional instability, and papers made from more highly refined pulps, such as SCK and Glassine release papers, tend to be more sensitive to moisture pickup and consequent shrinkage and curling. Ideally, shrinkage should be less than about 15%, but realistic targets for shrinkage vary with the level of pulp refining as shown by production run data in table A below. This table illustrates how the more highly refined papers are more sensitive to shrinkage.

TABLE A

Actual shrinkage by pulp type (extent of refining)

| Pulp Refining or Grade | Average Shrinkage (%) | Range of Shrinkage (%) |
|---|---|---|
| less refined, UFS | 8.6 | 5-11 |
| moderately refined, SCK | 10.6 | 7-14 |
| highly refined, Glassine | 13.3 | 11-15 |

Smoothness is a measure of the evenness or roughness of the surface of the fibrous sheet. The standard measure of this property is the Parker Print Surf (PPS) which measure the surface variability (e.g. from peaks to valleys) in microns (μm). Smoother surfaces have smaller variability and lower PPS values. TAPPI Standard T-555 explains this measure in more detail. As noted above, supercalendering or calendering under extreme conditions may improve the density and smoothness, but it is desirable for an uncoated paper to have PPS value of less than about 2.0 microns, or less than about 1.9 microns, or less than about 1.8 microns, or less than about 1.7 microns, or less than about 1.6 microns.

Gurley Porosity (or Gurley density) is a measure of the paper's permeability to air and refers to the time (in seconds) required for a given volume of air (100 cc) to pass through a unit area (1 in.$^2$=6.4 cm.$^2$) of a sheet of paper under standard pressure conditions. The higher the number, the lower the porosity, and the better the paper for release base use. As noted above, coatings may improve the permeability and porosity, but it is desirable for an unsized and uncoated paper to have a Gurley Porosity value of at least about 300, or at least about 400, or at least about 500, or at least about 600, or at least about 800, or at least about 1000 seconds.

Apparent Density often correlates with porosity, but is measured as mass per unit volume. In practical terms is determined by dividing the basis weight (usually expressed as lbs/3000 ft$^2$) by the thickness (caliper in thousandths of an inch or "mils") and typically expressed in lbs. (for 3,000 ft.$^2$) per mil for release base grades in North America. Higher apparent density means a less porous sheet with better caliper control and a harder surface (important in label die cutting). As noted above, supercalendering or calendaring under extreme conditions may improve the density and smoothness, but it is desirable for an uncoated paper to have an apparent density of at least about 17.8, or at least about 17.9, or at least about 18.0, or at least about 18.1 lbs/mil.

Bleedthrough (and "holdout") are related to porosity (at least in the absence of sizings or other coatings) and refer to the paper's resistance to the flow of a liquid from the surface into and through the sheet. A dark liquid like a neocarmin red dye or an ink stain can be applied and after a few minutes wiped off. The extent to which the dark dye penetrates the paper can be estimated on the obverse side as a measure of holdout. A first estimation of holdout penetration is the relative change in brightness of the obverse side of the sheet. This can be measured with optical reflectance as shown by TAPPI Standard Test Method T-452 (units are % relative to a white control) or it can be estimated as a % reduction in reflectance compared to the unstained paper. Acceptable holdout for unsized and uncoated paper is indicated if the loss or reduction in reflectance is less than about 25%, less than about 20%, less than about 15%, or less than about 10%. Alternatively, holdout can be estimated as the % area on the obverse side that is darkened by the dye. The "Dirt Estimation Chart" from TAPPI Test Method T-437 is useful for this purpose. Acceptable holdout for an unsized and uncoated paper is shown by penetration of less than about 3%, or less than about 2.5%, or less than about 2%, or less than about 1.5% of the obverse area.

Opacity is a fundamental optical property of paper and is determined by a ratio of two reflectance measurements: the test sample and a standard of known reflectance (e.g. usually 89%, TAPPI Standard T-425). Opacity is thus expressed as a percent value. The opacity of the sheet is influenced by thickness, the amount and kind of filler, degree of bleaching of the fibers, and coatings. Again for fair comparisons, tests performed herein refer to unsized and uncoated release base papers since calendering and coatings can easily impact opacity. Opacity is generally not a concern for commercial papers of 50 or 60 lbs basis weight or more. However, for papers that are 45 lb./3,000 ft.$^2$ and lighter that are used in labeling applications, low opacity is desired. Low opacity aids in optically monitoring when a label has (intentionally or otherwise) been removed from its release paper backing. The typical maximum opacity for lighter weight papers is approximate 60%, with typical opacities running in the 55 to 58% range for SCK and slightly lower for glassines.

The present invention contemplates novel release base papers having, in the unsized and uncoated state, two or more of the above described properties, and yet having a fibrous composition including from about 0.5% to 20% CNF based on the weight of the total pulp fiber, the remainder of the fibrous composition being less refined. Less refined pulp here refers to not just to UFS pulp, but to other pulps refined to no more than 60% fines. For example, as shown in the Examples, less refined UFS pulp mixed with 5 to 10% CNF has produced unsized and uncoated release base papers with desirably high Gurley Porosity values (low air permeability) of 700 or more and also PPS (S-10) smoothness values below 1.7 microns and possessing good dimensional stability (low shrinkage) as well.

Release Agents

The presence or nature of the release agent is not critical to the present invention, but will be described briefly. Release agents are applied to the release base papers to form release papers. The release agents are generally inert coatings that allow a secondary layer to be easily removed. Pressure-sensitive adhesive labels, such as name tags of the well known Avery™ or Dennison™ labels used in many business offices provide one good example of a secondary layer applied to a release paper. The secondary layer is the label itself which, along with its adhesive layer, must be easily removable from the release paper backing.

While complexes of trivalent chromium with fatty acids (e.g. Quilon®, developed by DuPont and now produced by Zaclon), certain fluorocarbons, and certain acrylates may be used as release agents, over 95% of release paper currently produced uses a silicone as release agent. Silicones are the only release coating materials that can achieve the very high degree of release needed for most pressure sensitive applications which account for over 93% of the release paper market. Also they are the best regarding health and environmental issues.

Silicone coating systems generally involve at least two components: the backbone silicone material and the catalyst. The backbone silicone materials include silicone acrylates (generally for UV cure), organopolysiloxanes (Si—O—Si) (the most common is polydimethylsiloxane (PDMS)), and silane-vinyl and Si-hexenyl compounds. The catalysts generally are organo-metallic compounds, and they catalyze either an addition reaction (using either platinum or rhodium based catalysts) or a condensation reaction (using a tin-based catalyst). Platinum addition reactions are more common. Other ingredients commonly found in silicone coating systems include:

- a release "modifier," usually a different silicone material used to change the release characteristics;
- an "inhibitor" material to delay cure of the silicone (e.g. by increasing the cure temperature) and extend coating pot life to a practical length;
- an adhesion promoter to improve bonding between coating and substrate (especially important in coating films); and
- for UV-cured coatings, a photo initiator to start the curing process.

Silicones may be categorized based on their curing method and their delivery vehicle. Thus, silicone release agents may be thermally-cured or radiation-cured; and they may be delivered in an organic solvent, an aqueous emulsion or via a "solventless" system. Solventless systems already dominate the majority of the release paper market and are growing in popularity, as and are the only delivery vehicle that can avoid a thermal curing mechanism. Solventless coatings are also the most difficult from the standpoint of the release base substrate. In order to get coating viscosities adequately low, the molecule size is very small, increasing the degree of penetration into the paper's pores. Thus, the ability of the present invention to produce lower porosity is particularly important when such coating materials are involved.

Some exemplary silicone coatings and manufacturers include Syl-Off® (Dow-Corning, Midland, Mich.), Silcolease® (Bluestar Silicones, East Brunswick, N.J.), Tego® (Evonik Goldschmidt Corp., Hopewell, Va.) and Dehesive® (Wacker Chemical Corp., Adrian, Mich.). When used, a release agent is generally the most expensive portion of the structure, so it is used as sparingly as possible. With paper and sizing innovations, silicone coating rates have gradually decreased over the past decade from over 1 lb per 3000 $ft^2$ to less than this amount. A typical range now is from about 0.5 to about 0.9 lbs/3000 $ft^2$ although lower amounts are still desirable, for example from about 0.2 to about 0.7 lbs/3000 $ft^2$.

Cellulose Nanofibers (CNF)

As cellulosic materials such as wood pulps are refined or comminuted, the size of the fibers decreases. This is described above and shown in the examples, wherein less refined UFS paper (e.g. 4000 revolutions of PFI mill) is contrasted with SCK and Glassine papers that are more highly refined ((e.g. 7000 and 10,000 revolutions of PFI mill, respectively). When sufficient energy is expended in this milling process, the resulting fibers may be broken down to the nanofibrils of cellulose polymers described above as the building block components of cellulosic materials. This process is well documented in the literature, for example in U.S. Pat. No. 8,377,563 and patent publications WO2011/128322A2, WO2012/098296A1 among others. Such CNF have unique properties, although the manner in which CNF is made is not critical to the present invention. Nanofibrillated cellulose is a synonym for CNF.

The extent of comminution may be monitored during the process by any of several means. Certain optical instruments can provide continuous data relating to the fiber length distributions and % fines, either of which may be used to define endpoints for the comminution stage. Such instruments are employed as industry standard testers, such as the TechPap Morphi™ Fiber Length Analyzer. As fiber length decreases, the % fines increases. As used herein "fines" refers to fibrils of 0.2 mm or less in length. Any suitable value may be selected as an endpoint for CNF production, for example at least 80% fines. Alternative endpoints may include, for example 70% fines, 75% fines, 85% fines, 90% fines, etc. Similarly, endpoint lengths of less than 1.0 mm or less than 0.5 mm or less than 0.1 mm may be used, as may ranges using any of these values or intermediate ones. Length distributions may be examined as average length or the percent less than a particular target length, for example a median length (50% less than) or any other decile, such as 90%, 80%, 70%, etc. for any given target length.

Fiber freeness and the slurry viscosity may also be used as an endpoint to monitor the effectiveness of the mechanical treatment in reducing the size of the cellulose fibers. As noted, freeness decreases with increased refining. Slurry viscosity may be measured in any convenient way, such as by Brookfield viscometer in units of centipoises or inverse seconds ($sec^{-1}$).

Process Variations

Figure 6:
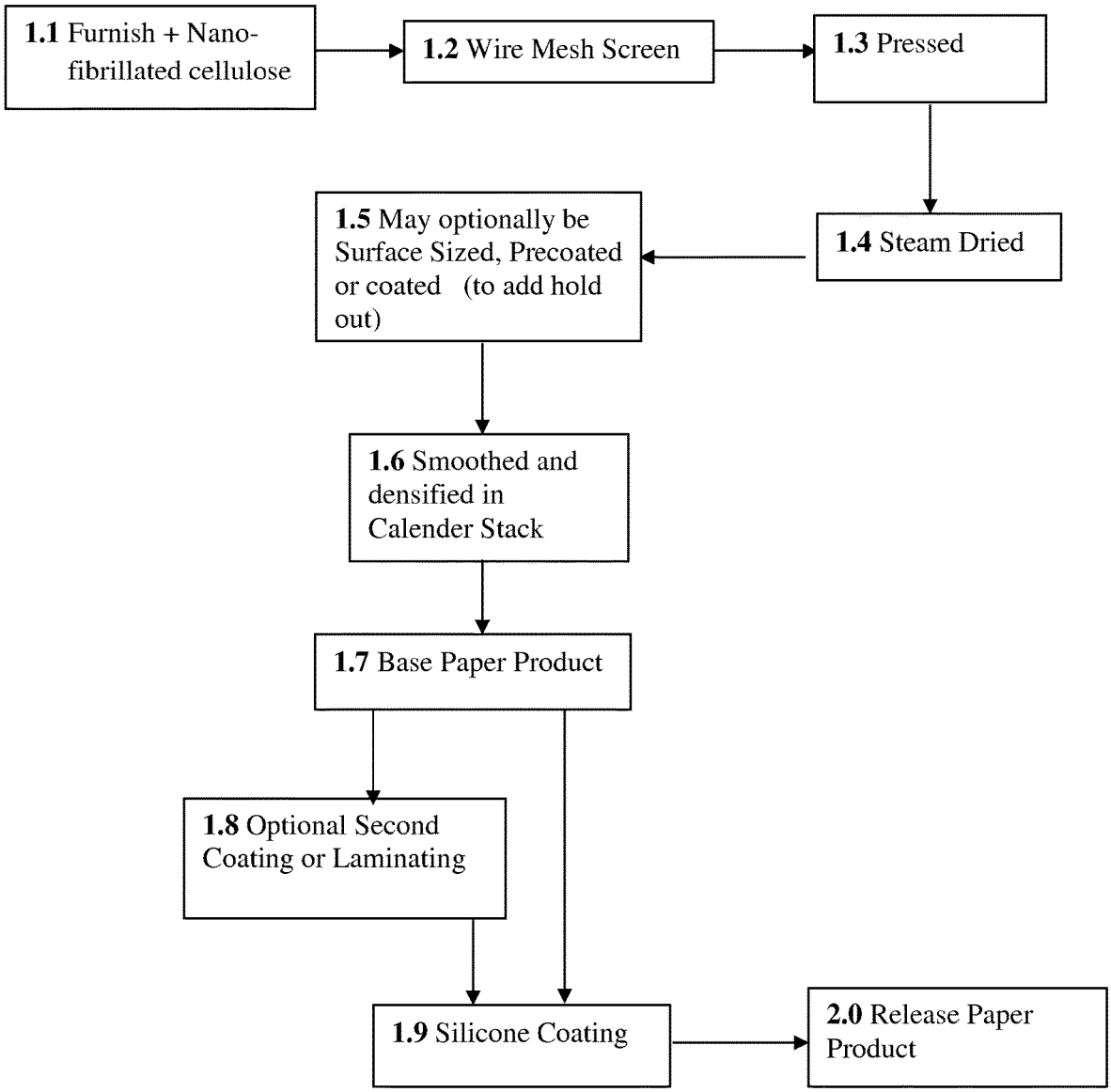
FIGS. 6 and 7 are alternative embodiments of generalized steps of the method of manufacture.

In one embodiment of the invention, CNF is added to the paper-making furnish and introduced at the headbox. Referring now to FIG. 6, nano-fibrillated cellulose is added to a furnish 1.1 consisting of but not limited to fibers, minerals, chemicals, dyes, and water. The furnish along with the nano-fibrillated cellulose is then extruded as an aqueous slurry onto a wire mesh screen 1.2, that rotates, using suction from underneath in order to dewater the furnish 1.1. The furnish and nano-fibrillated cellulose 1.1 still containing approximately 80% of its water is then pressed 1.3 in order to extract more water. The furnish and nano-fibrillated cellulose 1.1 is then steam dried 1.4 to remove the remaining water that is still contained within the furnish. The furnish and nano-fibrillated cellulose 1.1 may be subsequently sized, precoated or coated 1.5 with, but not limited to starch, in order to add holdout to the final paper product. The furnish and nano-fibrillated cellulose 1.1 is then smoothed and densified in the calender stack 1.6 producing a paper product 1.7. The base paper product 1.7 can be sized, precoated or coated 1.8 a second time with an inorganic or petroleum materials before the application of the silicone coating 1.9.

When used in the furnish, the loading dose or concentration of CNF is from about 0.5% to about 20% based on the dry weight of the pulp fiber. In paper industry terms, this equates to from about 10 lbs/ton to about 400 lbs/ton. In other embodiments, the loading concentration is from about 50 lbs/ton (2.5%) to about 200 lbs/ton (10%), or from about 75 lbs/ton (3.75%) to about 150 lbs/ton (7.5%), based on the dry weight of the pulp fiber.

Figure 7:
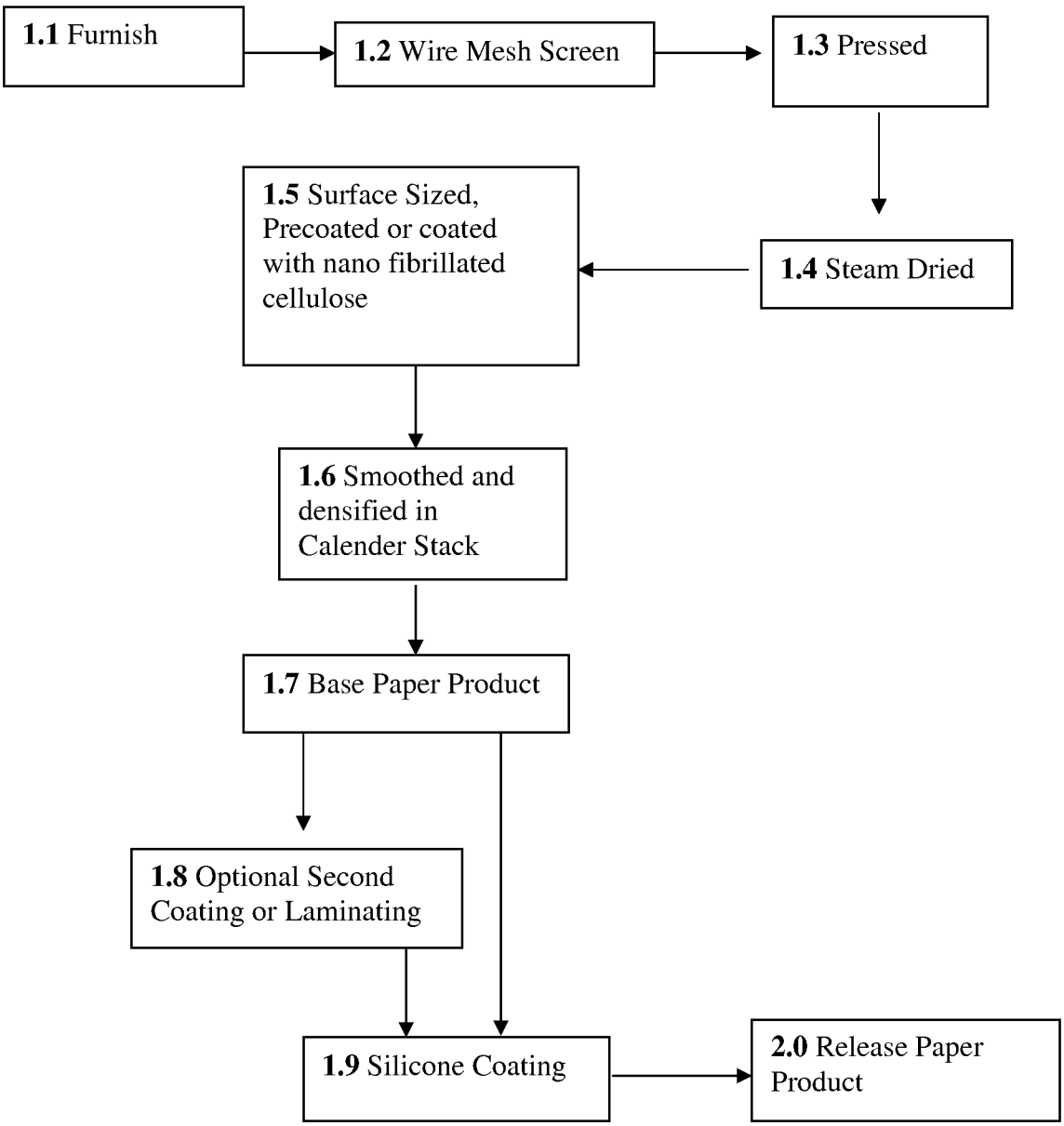

In an alternate embodiment of the present invention shown in FIG. 7, the nano-fibrillated cellulose is not added to the furnish 1.1, but it is added as a coating during the sizing, precoating, or coating step 1.5. The remaining steps of FIG. 7 are essentially the same as those described above in connection with FIG. 6.

When used as a sizing, pre-coating or coating, the CNF concentration or load is expressed as "add-on" weight based on the area of the sheet. The CNF coating concentration is thus from about 0.2 $g/m^2$ to about 15 $g/m^2$. In other embodiments, the CNF concentration or load is from about 0.5 $g/m^2$ to about 10 $g/m^2$ or from about 1.0 $g/m^2$ to about 5 $g/m^2$.

In a further embodiment, the cellulose nanofibrils (CNF) may be used both in the furnish and in a sizing, precoating or coating stage. This may have an added benefit of reducing the load or concentration of CNF by half or more in each stage.

In any of the above-described embodiments, the use of nano-fibrilated cellulose (CNF) permits the manufacture of release base papers starting with lightly refined grades of pulp, such as fiber pulps with a CSF freeness of greater than 180, or greater than 200. In some embodiments, the fiber pulp freeness may be greater than 220, greater than 250, greater than 275 or even as high as 300. Starting with this less refined fiber pulp creates several important advantages. First, the use of less refined fiber pulps reduces energy costs since less milling of the fiber pulps is required. Second, the use of less refined fiber pulps may improve processing efficiency. Even when CNF is added to the furnish, thereby reducing headbox freeness, the higher starting freeness allows the quicker and easier removal of water and saves energy in the drying stages. Third, the use of less refined fiber pulps improves dimensional stability and avoids shrinkage mismatches between the release papers and the secondary layers applied thereto.

Further advantages may arise in that the smoother surface characteristics and the lower porosity (air permeability) of the base paper permit milder calendering conditions and reduced or eliminated surface sizes and/or pre-coatings while still achieving acceptable silicone coating performance. It is also probable that reduced silicone usage will be enabled by the smoother surfaces. A lower opacity of the release paper may also be advantageous as it permits improved detection of when a label is removed during high speed label application operations.

Starches and Crosslinkers

In some embodiments, a starch is optionally added to the furnish or size coating along with the CNF. The nature of the starch is not critical. Corn, potato, tapioca and pearl starch are all suitable starches. The starch may be unmodified or modified and may be used singly or in blends or two or more of the same or different type. Non-limiting examples of modified or derivatized starches include oxidized, roasted, cationic, hydroxyethylated, hydroxypropoxylated, carboxymethylated, octenyl-succinic anhydride (OSA) modified starch. If a blend comprises two unmodified starches from different sources, or two different types of modified starch, or an unmodified and a modified starch, the blend may be varied in virtually any ratio, e.g. in proportions ranging from 95:5 to 5:95.

Starch, if used, may be added to the CNF in amounts from about 10% to about 300% (3×) on a weight basis relative to the CNF. In some embodiments, a starch may be used in amounts from about 50% to about 150% relative to the weight of the CNF. In other embodiments, the starch may be used in roughly equal weight amounts as the CNF.

If a starch is used, there may also be used a crosslinker that helps link the hydroxyl groups of the starch with the hydroxyl groups of the cellulose nanofibrils and may thus form gels. Such crosslinkers are well known and need not be described in detail. Many useful crosslinkers are thermally cured and benefit from a brief heating step (consistent with manufacturer recommendations) that aids the crosslinking. One such crosslinker is CereGel™ A, Cerealus, LLC, Waterville, Me. The crosslinker, when used, may be present in an amount from about 3% to about 10%; or from about 4% to about 9%; or from about 5% to about 8%, in each case based on the weight of the starch. Starches and crosslinkers are optional ingredients in the CNF mixture whether added as a furnish or as a coating, as described in more detail herein.

Industrial Uses of Release Base Papers

Release base papers, as the name implies, serve as a base to which a coating of a release agent is added to form a "release paper." Release papers, in turn, serve as a substrate for a secondary layer in many applications. Examples of substrates with secondary layers include, for example, pressure-sensitive adhesive labels, such as name tags of the well known Avery™ or Dennison™ labels used in many business offices, as well as "casting substrates" for industrial polymeric or thermoplastic films. In other applications, the release paper may be used without a secondary layer, for example with certain food processes, such as baking cups and sheets or interlayers between sliced foods.

EXAMPLES

The following examples serve to further illustrate the invention. Throughout the examples and this application, TAPPI Standards refer to the standards published by the Technical Association of the Pulp and Paper Industry, and to the versions current at the time of filing.

Example 1

Release Base Papers Made with Cellulose Nanofibrils

This example demonstrates the improved method of producing release base papers according to the methods of the invention.

The Synergy grade of northern bleached kraft pulp, produced by Sappi Fine Papers North America as a blend of 85% hardwood kraft and 15% softwood kraft pulp, was refined in a PFI laboratory refiner. The degree of refining is a key parameter in producing most grades of paper. Release papers, such as Supercalendered Kraft (SCK) release base and Glassine base typically use furnishes containing highly refined fibers compared to publication papers, such as Uncoated Freesheet (UFS). The relative refining levels typically used for these grades of paper are noted in Table 1. Fiber samples were collected after 4,000, 7,000 and 10,000 revolutions in the PFI refiner, which correspond respectively to UFS, SCK and Glassine grade papers. These fiber samples produced pulps with fiber freenesses of 295 ml, 165 ml and 105 ml, respectively, as measured by TAPPI Standard Method T-227 Canadian Standard Freeness measure of pulp. Handsheet samples A, B and C were produced from these pulp samples in accordance to TAPPI Standard Method T-205, but at a basis weight of 60 lbs/3000 $ft^2$.

Fibers refined to 4,000 revolutions in the PFI refiner (UFS grade) were also blended with cellulose nanofibrils (CNF) in accordance with an embodiment of the invention. The CNF was produced at the University of Maine Cellulose Nano-fibril pilot plant. Synergy pulp was processed until the fines content was 90% on a length-weighted basis, as measured by the TechPap Morphi Fiber analyzer.

For Sample D, the CNF was added to the refined pulp at a loading concentration of 100 lbs/ton (ppt) of dry fiber. For Samples E and F, the CNF was mixed with an equal amount by weight of starch. The starch was a blend of 80% unmodified pearl corn starch and 20% cationic corn starch, both manufactured by Tate & Lyle, Decatur Ill. The CNF and starch mixture, at 3% solids, was heated to approximately 200 F for 30 minutes, thoroughly cooking the starch. A cross-linking agent, CereGel A, Cerealus, LLC, Waterville, Me., was added to the mixture under moderate agitation at a rate of 7 wt %, based on the mass of starch in the mixture. This final mixture was then used as a furnish additive at 100 (Sample E) or 200 (Sample F) lbs/ton of fiber.

Handsheets A through F were produced from six sets of furnishes as listed in Table 1. No surface sizes or precoatings were applied. A list of properties determined for each test set, and a reference to the specific test methods used, is listed in Table 2.

TABLE 1

List of Handsheets Produced

| Sample ID | Sample Description | Refining Level PFI revs | CNF Loading, ppt | CNF-Starch Loading, ppt | Comment |
|---|---|---|---|---|---|
| A | UFS refining | 4000 | 0 | 0 | Typical UFS refining level |
| B | SCK refining | 7000 | 0 | 0 | Typical SCK refining level |
| C | Glassine refining | 10000 | 0 | 0 | Typical Glassine refining level |
| D | UFS 100 ppt CNF | 4000 | 100 | 0 | |
| E | UFS 100 ppt CNF-Starch | 4000 | 0 | 100 | |
| F | UFS 200 ppt CNF-Starch | 4000 | 0 | 200 | |

TABLE 2

Properties Tested

| Property | Units | TAPPI Standard Test Method |
|---|---|---|
| Apparent Density | Lbs./0.001 inches | T-220 |
| Gurley Porosity | Seconds/100 cc of air | T-460 |
| Smoothness | Microns, 10 kg clamping pressure, soft backing | T-555 |
| Shrinkage | % | T-476 |
| Opacity | % | T-425 |

The data from Example 1 is presented in FIGS. 1 to 4 and Table 3 below. The first three data points in FIG. 1 show that as refining is increased from 4,000 to 10,000 PFI revolutions, the porosity of the paper decreases significantly, as represented as increasing Gurley Porosity. When cellulose nanofibrils are added to lightly refined fibers (4,000 PFI revolutions) at 100 ppt (Sample D), the porosity of the paper decreases to a level in the range of typical SCK and Glassine release papers. In another embodiment of the invention, CNF treated with starch then added to the furnish further decreases the porosity of the paper (i.e. higher Gurley Porosity) and, at the loading of 200 ppt (Sample F), is well beyond the level achieved at Glassine refining levels (10,000 PFI revolutions). Note that because of the equal weight combination, 200 ppt of CNF-starch (Sample F) contains the same amount of CNF as 100 ppt of CNF alone (Sample D).

Figure 2:
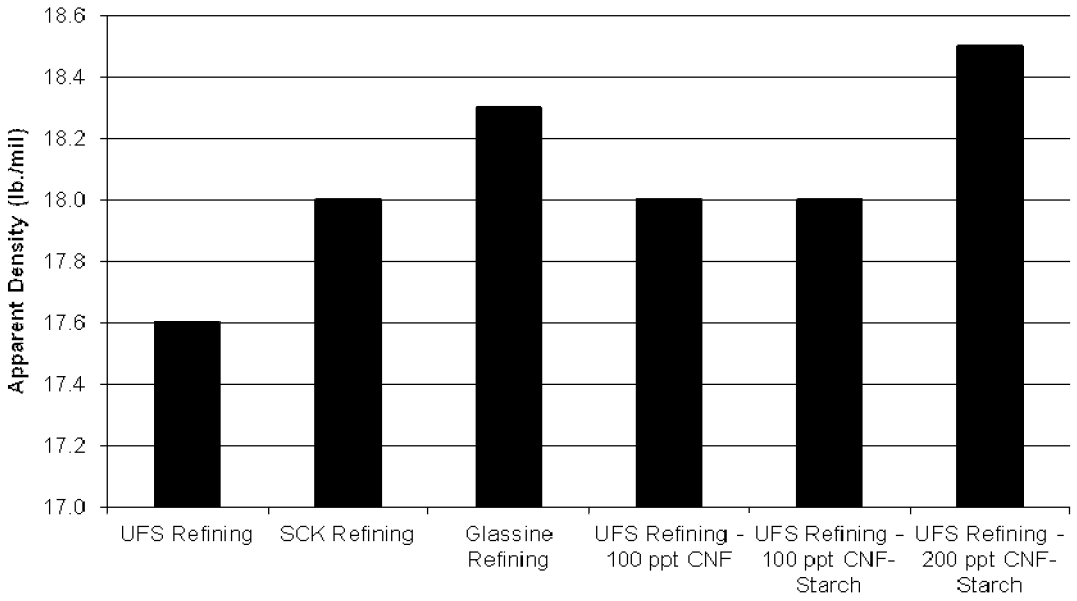

Sheet density is also an important property for release base papers. Highly refined pulp has traditionally been used to achieve the high sheet densities required for release base papers. FIG. 2 shows the impact refining has on sheet density, as measured by apparent density, and how the addition of CNF to a less-refined paper can develop sheet densities comparable to SCK refining (7,000 PFI revolutions), even with lightly refined pulp. FIG. 2 also shows that the addition of CNF-Starch to lightly refined pulp can increase the sheet density beyond that achieved with very high levels of refining (10,000 PFI revolutions).

Figure 3:
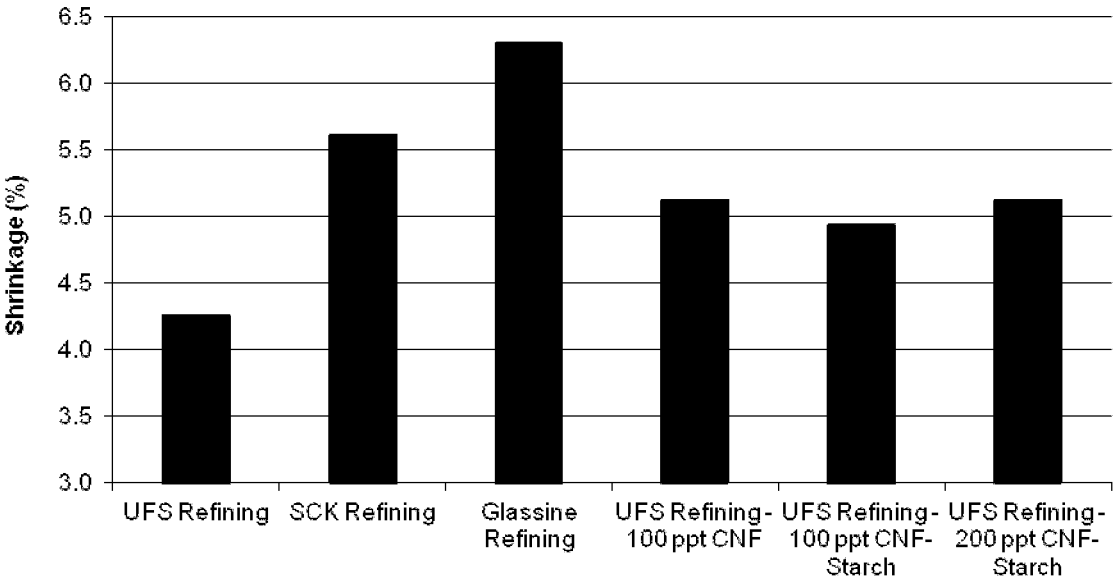
Figure 4:
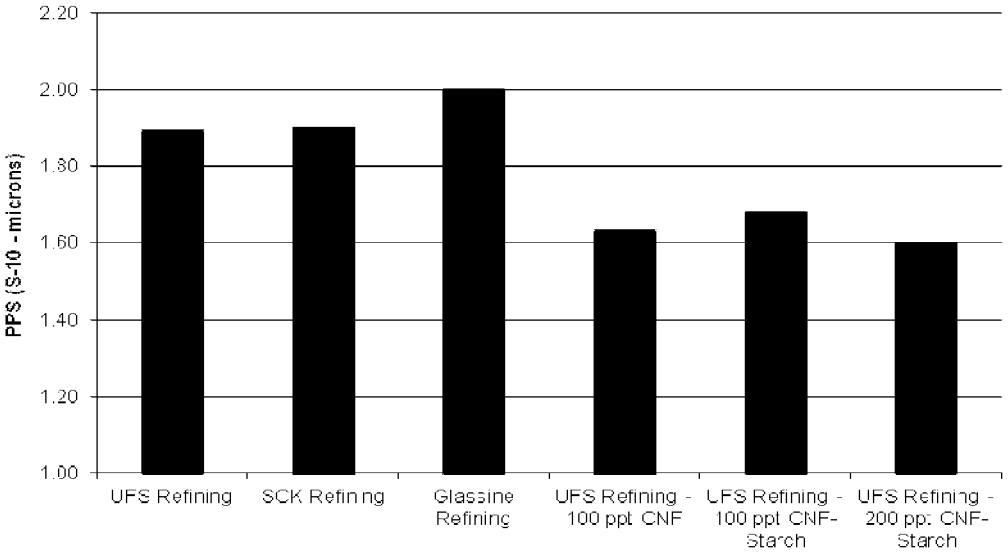

Another advantage to this invention is improved dimensional stability, as measured by sheet shrinkage which is inversely related to dimensional stability. Highly refined pulps like SCK and Glassine generally have poorer dimensional stability than less refined pulps like UFS. This is important in label applications where the face sheet is generally produced with lightly refined fibers, similar to that of UFS, while the release base is produced with highly refined pulp to generate the high sheet density and low porosity, creating a potential shrinkage mismatch. FIG. 3 shows how sheet shrinkage increases rapidly with increased refining. The addition of CNF, with or without starch addition, to lightly refined pulp increases sheet shrinkage, but less than refining alone does, resulting in a CNF-containing release base paper that is more dimensionally stable than the prior art. This fact is demonstrated by the data. Although the shrinkage % values differ somewhat from those of Table A, this is thought to be due to the handsheet nature of these samples prepared on slower, pilot lines instead of commercially produced products.

Smoothness of the paper surface is another important property of release papers. A smooth surface generally requires less silicone to be applied to impart the necessary release characteristics and end-use performance. Silicone is the most expensive component in release papers and therefore its efficient use is critical to controlling manufacturing costs. Refining is not very effective in controlling paper smoothness at the low range of freeness currently used in manufacturing release base papers, as evidenced by FIG. 4. However, the addition of cellulose nanofibrils, with or without starch addition, was found to significantly improve the smoothness (i.e. lower Parker Print Surf Smoothness) of release base paper.

Opacity of the papers is also reduced using the CNF and CNF-starch formulations of the present invention. This effect is modest however, at the higher basis weights of these handsheets.

Selected data for several of the uncoated test papers of Example 1 are collected in Table 3.

TABLE 3

Selected data from Example 1

| Sample ID | Sample Description | Apparent Density (lbs/mil) | Gurley Porosity (sec) | PPS -10 Smoothness (microns) | Shrinkage (%) | Opacity (%) |
|---|---|---|---|---|---|---|
| A | UFS refining | 17.6 | 120 | 1.89 | 4.26 | — |
| B | SCK refining | 18.0 | 438 | 1.90 | 5.61 | 73.40 |

TABLE 3-continued

Selected data from Example 1

| Sample ID | Sample Description | Apparent Density (lbs/mil) | Gurley Porosity (sec) | PPS -10 Smoothness (microns) | Shrinkage (%) | Opacity (%) |
|---|---|---|---|---|---|---|
| C | Glassine refining | 18.3 | 1262 | 2.00 | 6.30 | — |
| D | UFS 100 ppt CNF | 18.0 | 739 | 1.63 | 5.12 | 73.18 |
| E | UFS 100 ppt CNF-Starch | 18.0 | 531 | 1.68 | 4.94 | 72.28 |
| F | UFS 200 ppt CNF-Starch | 18.5 | 1580 | 1.60 | 5.12 | 72.02 |

Example 2

Performance of Release Papers

This example demonstrates the improved performance of release base papers produced according to the invention.

Two release base papers were produced on the pilot paper machine at the University of Maine. Both papers were produced from a blend of 30% northern bleached softwood kraft pulp and 70% northern bleached hardwood kraft pulp and at a nominal basis weight of 50 lbs/3000 $ft^2$. The first paper, labeled Control in Table 3, was made from a fiber furnish that was heavily refined resulting in a headbox freeness of 95 ml (TAPPI Standard Method T-227 Canadian Standard Freeness). The second paper, labeled CN200 in Table 3, was made according one embodiment of the invention in which a CNF-Starch mixture (as described in Example 1 above) was added to the fiber furnish at a loading rate of 200 lbs/ton of fiber. The kraft pulp was much less refined that that used to manufacture the control paper, which resulted in a headbox freeness of 200 ml. The higher headbox freeness allows the water to be removed from the forming web more easily and offers opportunity to increase production rate, reduce energy usage or a combination of both. These two papers—to which no surface sizes or pre-coatings were applied—were then hot soft nip calendered with a single nip per side at 180 degrees Fahrenheit and 500, 1,500 and 3,000 pounds/linear inch (pli).

The test results from the two uncoated release base papers are given in Table 3. All testing was performed in accordance to TAPPI Standard Test Methods referenced in Example 1. The release paper made according to the invention showed improved sheet density, porosity and dimensional stability over the control paper, even with less refining of the kraft pulp resulting in higher headbox freeness.

TABLE 3

Test Results of Base Papers

| Property | Control | CN200 |
|---|---|---|
| Apparent Density (lb/0.001 inches) | 14.0 | 14.2 |
| Gurley Porosity (Seconds/100 cc of air) | 300 | 700 |
| Shrinkage (%) | 7.5 | 7.2 |

Both release base papers were then surface coated with a thermal-cure silicone at a coat weight of 0.71 lbs/3000 $ft^2$ and cured. A neocarmin dye stain was then applied to the silicone surface for approximately 2 minutes and then wiped off. The amount of stain showing through the opposite side of the paper is an indication of the ability to prevent adhesive from "bleeding through" the release paper. Silicone coating and/or adhesive bleedthrough is a major source of end use problems, particularly in pressure sensitive label applications.

Figure 5:
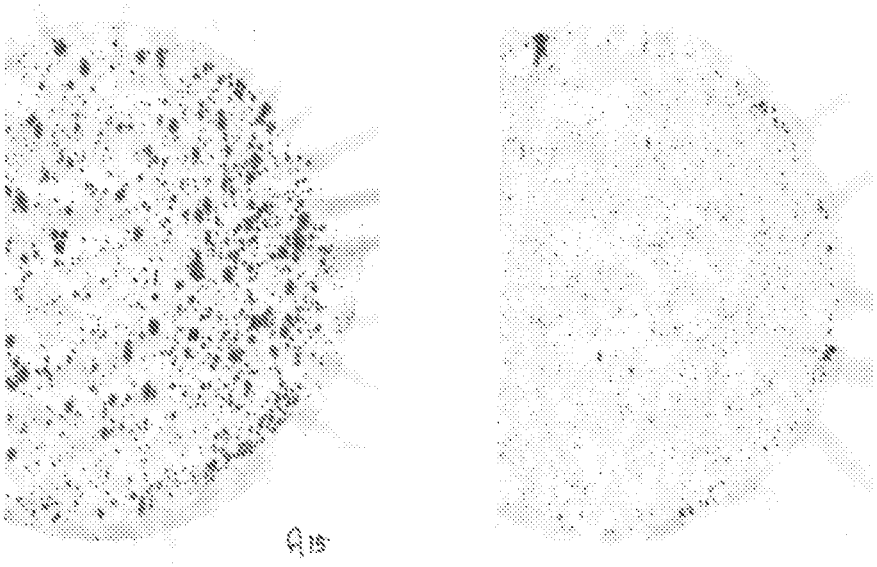
FIG. 5 is an image comparing the holdout properties of a control and experimental paper.

The CNF-Starch containing release base paper produced according to the invention demonstrated a remarkable and unexpected ability to prevent the test stain from penetrating the silicone coated release paper compared to the control paper. (See FIG. 5) The brightness of the control paper, as measured using the TAPPI Standard Test Method T-452, was only 29.7% compared to 77.5% for the CN200 paper indicating that much more of the dark dye had penetrated the control sheet compared to the CNF-Starch containing paper. These reflectance values are estimated to be reductions or losses of about 64% and 6%, respectively, from the un-dyed paper. As a second check on the amount of penetration, the actual area penetrated by the dye was estimated using the "Dirt Estimation Chart" from TAPPI Test Method T-437. It was determined that the area penetrated was 2.7 times greater for the control sheet compared to the CNF-Starch containing sample (3.2% penetration vs. 1.2% penetration).

The foregoing description of the various aspects and embodiments of the present invention has been presented for purposes of illustration and description. It is not intended to be exhaustive or all embodiments or to limit the invention to the specific aspects disclosed. Obvious modifications or variations are possible in light of the above teachings and such modifications and variations may well fall within the scope of the invention as determined by the appended claims when interpreted in accordance with the breadth to which they are fairly, legally and equitably entitled.

What is claimed is:

1. A release paper comprising a release base paper coated with a release agent, wherein the release base paper is manufactured from a furnish comprising:

a. a paper-making pulp having an initial fiber freeness (CSF) of from about 180 ml to about 300 ml; and b. nano-fibrillated cellulose having a fines content of at least about 90% and at a loading concentration of from 10 to about 400 lbs/ton, wherein the nano-fibrillated cellulose is premixed with a starch, the starch comprising a blend of unmodified starch and cationic starch.

2. The release paper of claim 1, wherein the starch assists in the dispersion within the furnish.

3. The release paper of claim 1, wherein the starch comprises potato, corn, pearl, or tapioca starches.

4. The release paper of claim 1, wherein said nano-fibrillated cellulose is first crosslinked to form a hydrogel before being added to the furnish.

5. The release paper of claim 1, wherein the furnish comprises a paper-making pulp having an initial fiber freeness (CSF) of from about 200 ml to about 300 ml.

6. The release paper of claim 1, wherein the furnish comprises a paper-making pulp having an initial fiber freeness (CSF) of from about 250 ml to about 300 ml.

7. The release paper of claim 1, wherein the nano-fibrillated cellulose consists of D-glucose units.

8. A release paper comprising:

a release base paper manufactured from a furnish comprising a paper-making pulp having an initial fiber freeness (CSF) of from about 180 ml to about 300 ml; and nano-fibrillated cellulose at a loading concentration of from 10 to about 400 lbs/ton, wherein the nano-fibrillated cellulose is premixed with a starch, the starch comprising a blend of unmodified starch and cationic starch in a ratio of about 80:20; wherein prior to any surface sizing or coating, the release base paper has at least two of the following properties:

a. a Gurley Porosity of at least 300 seconds;

b. a dimensional stability characterized by shrinkage of less than 10%;

c. a PPS (S-10) smoothness of less than about 2 microns;

d. an apparent density of at least about 17.8; and e. a holdout characterized by a dark dye penetration of (i) not more than about 3% of the obverse side area stained by dye in a dirt estimation test; or (ii) a reduction in reflectance or brightness of no more than about 20%;

and a release coating on the release base paper.

9. A release base paper according to claim 8, characterized by having the properties of porosity and smoothness.

10. A release base paper according to claim 8, characterized by having the properties of porosity and dimensional stability.

11. A release base paper according to claim 8, characterized by having the properties of holdout and smoothness.

12. The release paper of claim 8, wherein the nano-fibrillated cellulose consists of D-glucose units.

13. A release paper comprising a release base paper coated with a release agent, wherein the release base paper is manufactured from a furnish comprising:

a. a paper-making pulp having an initial fiber freeness (CSF) of from about 180 ml to about 300 ml; and b. nano-fibrillated cellulose at a loading concentration of from 10 to about 400 lbs/ton, wherein the nano-fibrillated cellulose consists of D-glucose units; and wherein the release agent comprises silicone.

* * * * *